US010401088B2

(12) United States Patent
Fradette et al.

(10) Patent No.: US 10,401,088 B2
(45) Date of Patent: Sep. 3, 2019

(54) HIGH TEMPERATURE VACUUM FURNACE HOT ZONE WITH IMPROVED THERMAL EFFICIENCY

(71) Applicants: Real Fradette, North Wales, PA (US); Benjamin Isaak, Souderton, PA (US); Robert Wilson, Warrington, PA (US)

(72) Inventors: Real Fradette, North Wales, PA (US); Benjamin Isaak, Souderton, PA (US); Robert Wilson, Warrington, PA (US)

(73) Assignee: William R. Jones, Telford, PA (US)

( * ) Notice: Subject to any disclaimer, the term of this patent is extended or adjusted under 35 U.S.C. 154(b) by 469 days.

(21) Appl. No.: 15/330,396

(22) Filed: Sep. 16, 2016

(65) Prior Publication Data

US 2018/0080714 A1 Mar. 22, 2018

(51) Int. Cl.

| | |
|---|---|
| ***H05B 3/66*** | (2006.01) |
| ***F27D 7/06*** | (2006.01) |
| ***F27D 11/02*** | (2006.01) |
| ***F27B 5/04*** | (2006.01) |
| ***F27D 1/00*** | (2006.01) |
| *F27D 9/00* | (2006.01) |

(52) U.S. Cl.

CPC ..... *F27D 11/02* (2013.01); *F27B 5/04* (2013.01); *F27D 1/0033* (2013.01); *F27D 7/06* (2013.01); *F27D 2007/066* (2013.01); *F27D 2009/0008* (2013.01)

(58) Field of Classification Search

CPC ..... F27D 11/02; F27D 1/00; F27D 1/0033; F27D 1/0036; F27D 1/04; F27D 7/02; F27D 7/06; F27D 2007/066; F27D 2009/0008; F27B 5/04; F27B 5/16; B23K 1/008; B23K 3/08; B23K 3/087; H05B 3/06; H05B 3/10; H05B 3/16; H05B 3/24; H05B 3/32; H05B 3/62; H05B 3/64; H05B 3/66

USPC ..... 373/109, 110, 111, 112, 113, 118, 120, 373/122, 125, 128, 130, 132, 134, 137; 219/390, 408, 520, 532, 539, 541, 542, 219/552, 553

See application file for complete search history.

(56) References Cited

U.S. PATENT DOCUMENTS 4,259,538 A 3/1981 Jones
4,489,920 A 12/1984 Jones
(Continued)

*Primary Examiner* — Hung D Nguyen
(74) *Attorney, Agent, or Firm* — Aaron Nerenberg

(57) ABSTRACT

This invention provides a high temperature vacuum furnace including a hot zone designed for improved energy efficiency resulting in lower electrical power usage, lower manufacturing costs and easier replacement of components for lower maintenance costs. The hot zone has an outer supporting wall and an inner insulating wall surrounded by a new HEFVAC high density, high strength, low conductivity and low moisture-sensitive graphite insulation board ring connected in a unique z-shaped arrangement that contains radiant energy within the hot zone during the heat treating cycle. The hot zone further includes heating elements made of high quality graphite for increased thermal efficiency of the furnace. Also included in the hot zone are lower mass, tapered graphite nozzles that can sustain high pressure gas flow and decrease conductive heat losses from the nozzles to the hot zone chamber outer supporting wall during the heat treating cycle.

18 Claims, 6 Drawing Sheets

(56) References Cited

U.S. PATENT DOCUMENTS

| | | | | | |
|---|---|---|---|---|---|
| 4,559,631 | A * | 12/1985 | Moller | H05B 3/66 | 373/130 |
| 5,502,742 | A * | 3/1996 | Kellogg | F27B 5/16 | 373/128 |
| 6,021,155 | A | 2/2000 | Jones | | |
| 7,514,035 | B2 | 4/2009 | Jones | | |
| 9,187,799 | B2 | 11/2015 | Wilson et al. | | |
| 2003/0160088 | A1* | 8/2003 | Mitten | B23K 1/008 | 228/219 |

* cited by examiner

HIGH TEMPERATURE VACUUM FURNACE HOT ZONE WITH IMPROVED THERMAL EFFICIENCY

FIELD OF THE INVENTION

This invention relates to high temperature vacuum heat treating furnace hot zones that include electric resistance heating elements, high strength, high density, low conductivity, and low moisture-sensitive graphite insulation boards, retention systems and high pressure cooling nozzles for producing high thermal efficiency during a high temperature heat treating cycle.

BACKGROUND OF THE INVENTION

With rising energy costs, especially high electric costs, and electricity use restrictions placed on heat treating companies in many states and countries, the need to develop more energy efficient heat treating furnace hot zones is a key priority. The furnace hot zone is the area within which a work piece is placed to be heat treated. The present invention includes some notable improvements over prior art hot zone arrangements for saving energy and reducing the overall costs of manufacturing, owning and operating a vacuum furnace. A uniquely designed insulation arrangement, heating elements and their connection joints, and lower mass cooling nozzle size and shape, result in improved energy consumption by the vacuum furnace, improved ease of fabrication and maintenance, and a significant reduction in the initial cost to build the furnace compared with current graphite vacuum furnace hot zones.

It is well known in prior art vacuum furnace fabrication that the hot zone contains an inner insulating wall and an outer wall known as the support ring—U.S. Pat. Nos. 9,187,799; 7,514,035; 4,559,631; 4,259,538; 6,021,155; and US2013/0175256A. The outer wall support ring typically is fabricated as a stainless steel or carbon steel ring and is situated and isolated within a water-cooled chamber. The inner insulating wall typically is fabricated with all metal radiation shields or a combination of graphite felt and foil, or rigidized graphite board. In one instance found in U.S. Pat. No. 4,489,920 ('920 patent), there is described a hot zone insulated by ceramic oxide fabricated boards. It is stated in the patent that the ceramic oxide fabricated boards are much lower in cost and the oxide will not interact with materials that evaporate from the work pieces, as does the graphite felt which the ceramic oxide boards replace. In tests using the ceramic oxide boards claimed in the '920 patent, major catastrophic failures occurred after several repeated process cycles in at least three production furnaces. The ceramic oxide boards were more hygroscopic (water absorbing) than the graphite felt predecessors. This resulted in longer furnace pump-down rates, especially during humid weather, causing lost production time. In the '920 patent the ceramic oxide boards were supported by multiple types of abutment supports, suggesting that the strength of the ceramic oxide boards were less than desired. The use of these multiple supports adds mass to the furnace and is a source of conductive heat loss from the hot zone where the work piece is being treated to the cold side of the support ring, resulting in higher energy usage and costs. In practice after a certain amount of usage the ceramic oxide boards began to fracture and deteriorate rapidly due to thermal shock during high pressure quenching. The weakness of the ceramic oxide boards was found to be due to the fact that the ceramic fibers were not interwoven or interlocked, resulting in a loss of strength when they were exposed to rapid heating and cooling. These two significant failures, extreme moisture absorption and brittleness, led to very costly down time, and repair and replacement costs. Heat treating furnace manufacturers returned to the use of graphite felt and foil insulation, and eventually felt/foil and board combinations in the manufacture of graphite insulated vacuum furnaces.

A major drawback to felt/foil and outer rigid insulation board designs is the need to hold the insulation package in place by retainers to prevent damage and breakage of the woven fibers during high pressure gas quenching. These retainers are typically made from graphite or molybdenum rods that are connected to the face of the insulation package and pass through the insulation to connect to the cold side of the support ring. Each connection from the inside of the inner hot zone wall to the outer support ring is a potential source for thermal losses during the heat treating cycle. The retainer pins according to the present invention are used only in those newly designed insulating board segments which do not have any other connection means to the hot zone support ring. This includes cooling nozzles that screw into the outer support ring, and heating element supports that connect the heating elements to the outer support ring. These three forms of connection means all serve as thermal loss conduits from the hot zone to the support ring, which in turn radiates out to the water-cooled outer chamber wall. Any design that reduces the number of insulation retainer pins helps to improve thermal efficiency in the hot zone. For example, a furnace with a 48 inch hot zone diameter and 50 inches in length may require up to 500 retainer pins as support for the felt/foil insulation package. This results in 500 apertures that are a source of thermal losses due to conduction between the hot zone and the outer support ring. The current design, which utilizes the high strength HEFVAC graphite boards according to the present invention, reduces the number of insulation retainer pins from 17 to 4 around the circumference of the furnace outer support ring. The overall number of retainer pins required according to the prior art designs decreases from approximately 500 to approximately 125. The number of heating element supports is also decreased in the current design from an average of 9 at the circumference to 4, or by greater than 50%.

As vacuum furnaces have improved through the use of high quality seals and valves, issues with oxygen exposure have been virtually eliminated, thus making the statements in the '920 patent, regarding the dangers of graphite felt in vacuum furnaces no longer relevant. It has therefore been the practice for the past 30 plus years to continue to use graphite insulation in vacuum furnaces that utilize graphite or molybdenum electrical resistance heating elements. It is customary for these types of heat treating furnaces to use electrical resistance heating elements, as shown and described in U.S. Pat. Nos. 4,559,631; 4,259,538; and 6,021,155. During the life of a vacuum furnace, the heating elements are subjected to many expansions and contractions as a result of hundreds of heating and cooling cycles. As the state of high pressure gas quenching has advanced, the thermal shock experienced by the heating elements has increased with each increase in pressure levels. Such increases in quench pressures are described in U.S. Pat. No. 9,187,799, where gas quench pressures up to 20 Bar in nitrogen are utilized. The advent of higher heat treating temperatures for specialty alloys has also introduced more stress on the heating elements, leading to increases in the number of failures. The increased stress from higher temperatures and more rapid cooling leads to increased occurrences of fracture of the heating elements, requiring improvements in heating element design for ease of replacement in the heat treating facility, as opposed to replacement in the furnace manufacturing facility. The polygon design shown and described in U.S. Pat. No. 6,021,155, uses a plurality of compensator bars to join straight molybdenum heating elements. Each compensator bar requires 4 nuts and bolts made of refractory material, and has a center aperture which allows connection of the heating element through the insulation package to the hot zone chamber outer wall. For each bank of heating elements there is a 2 to 1 element to retainer pin ratio in this prior art design. Each retainer pin adds to the overall level of conductive heat loss, as each pin is directly connected from the heating element to the hot zone outer stainless steel support ring. Reduction of the number of retainer pins and heating element locking fasteners helps to reduce the overall mass and number of penetrations in the hot zone, thereby reducing energy requirements for heating the hot zone to the required furnace operating temperature. This results in increased furnace efficiency and reduced operating costs.

Another improvement of the present invention over the prior art vacuum furnaces designed to further reduce the overall mass of the hot zone, and thereby increase furnace efficiency, is the design of the cooling nozzles. The current design nozzles are of a reduced size and a streamlined shape, and thus a lower mass when compared with the standard nozzles described and shown in U.S. Pat. Nos. 9,187,799 and 7,514,033.

SUMMARY OF THE INVENTION

These and other deficiencies of the prior art are overcome by the present invention. In one of its aspects this invention provides in a high temperature vacuum furnace including a hot zone comprising an inner wall and an outer support means, the inner wall comprising a plurality of high density, high strength, low conductivity, and low moisture-sensitive graphite insulation board means, each board means connected at one longitudinal edge thereof to an adjacent board means to form a continuous ring around the hot zone, and each one of the board means overlapping and engaging the adjacent board means to provide a tight fit with virtually no gap therebetween, whereby thermal radiation losses from the hot zone are virtually eliminated, the hot zone further including a plurality of electrical resistance heating element means arranged in a continuous ring within the hot zone adjacent to the board means ring, each one of the heating element means being operatively connected to an adjacent one of the heating element means at each of their respective longitudinal edges by a first connection means, and the heating element means ring being operatively connected to the insulation board means ring by a plurality of heating element standoff means.

In another of its aspects this invention provides an improved gas cooling nozzle means which is tapered and has a reduced mass for providing greater thermal energy efficiency and reduced conductive heat loss from the hot zone.

BRIEF DESCRIPTION OF THE DRAWINGS

The accompanying drawings illustrate a preferred embodiment of the invention, as well as other information pertinent to the disclosure, in which.

DETAILED DESCRIPTION OF THE INVENTION

Figure 1:
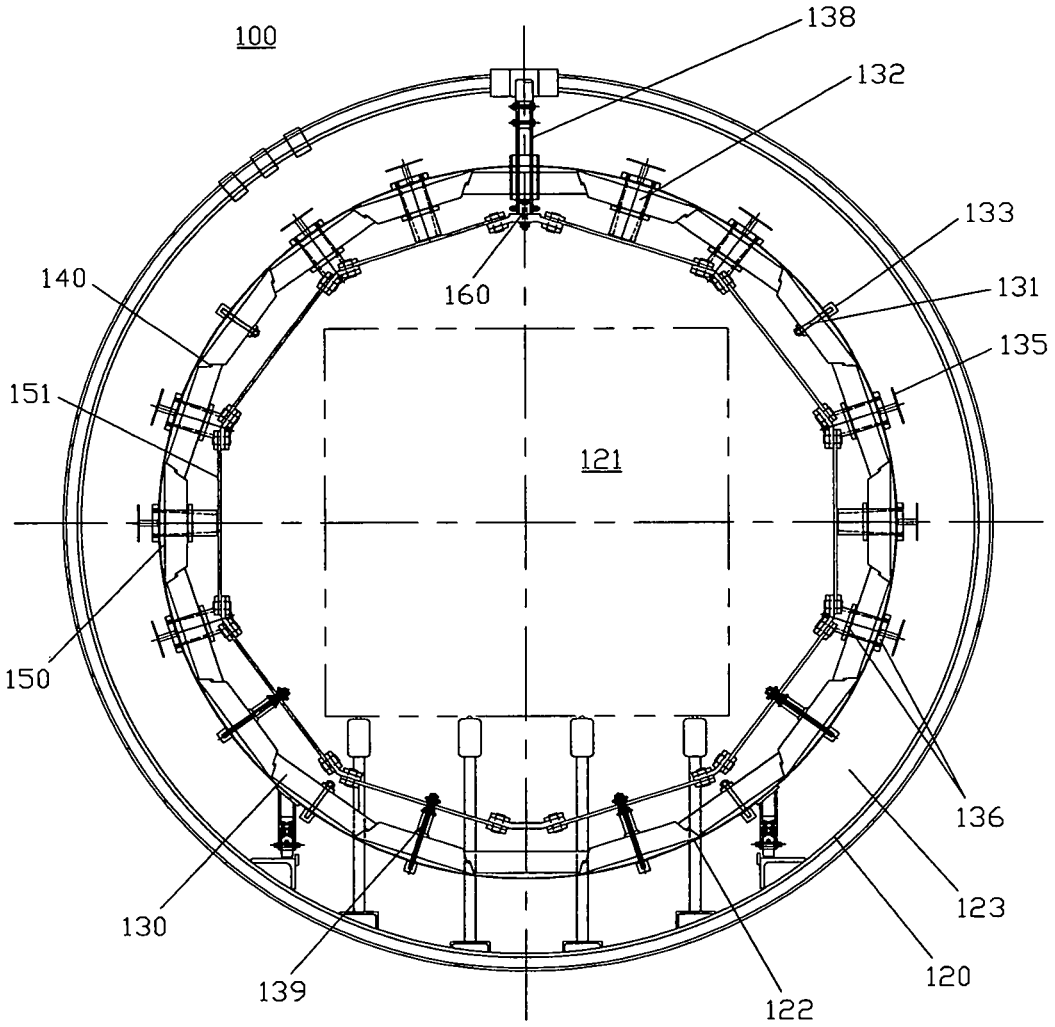
FIG. 1 is an end view of the furnace hot zone according to the present invention showing the arrangement of the HEFVAC graphite insulation boards, the insulation board retainers, the heating elements, the gas cooling nozzles and the power supply terminal.

Referring to the drawings in general and particularly to FIGS. 1 through 6, where like numerals identify like elements, there is shown a vacuum furnace 100 in accordance with the present invention. Furnace 100 typically includes an inner water-cooled chamber wall 120 which supports a hot zone chamber 121. Chamber 121 includes an outer wall support ring 122, which is typically a stainless steel ring designed to support the inner wall comprised of insulation boards 130, insulation board retainers 131, and gas cooling nozzles 132. Furnace 100 also includes a water-cooled power terminal 138 and heating elements 151. Power terminal 138 supplies electrical power to the heating elements to cause them to heat hot zone chamber 121 to a desired temperature. Water-cooled power terminals have been described in various prior art patents such as U.S. Pat. Nos. 4,559,631; 4,259,538; and 6,021,155; and they will not be further described with regard to the present invention. A pair of connector reinforcement plates 160 are an improvement over prior art furnace arrangements and are designed to stabilize the power terminal to the segmented heating elements 151. Between the water-cooled furnace inner chamber wall 120 and the outer stainless steel ring 122 is an open space which serves as a plenum 123, where high velocity cooling gas can flow from a quench fan (not shown) through the gas cooling nozzles 132 to the work piece (not shown) in hot zone 121. During vacuum heating, plenum 123 is under vacuum, and any radiative or conductive heat losses to support ring 122 could result in radiation losses from support ring 122 to the furnace chamber inner water-cooled wall 120.

Nozzle radiation shields 135, as shown and described in U.S. Pat. Nos. 9,187,799 and 7,514,035, are utilized in the present invention in their entirety. Shields 135 are made from molybdenum sheet that reflects heat back to hot zone chamber support ring 122 and away from the furnace chamber inner water-cooled wall 120. Since nozzles 132 are open during the heating cycle, there will be some radiation loss from hot zone 121 through the nozzle apertures. Radiation shields 135 restrict further losses to water-cooled wall 120, allowing furnace hot zone 121 to reach a set temperature and thus maintain a tight tolerance for temperature uniformity without an excessive input of electrical energy.

Figure 6:
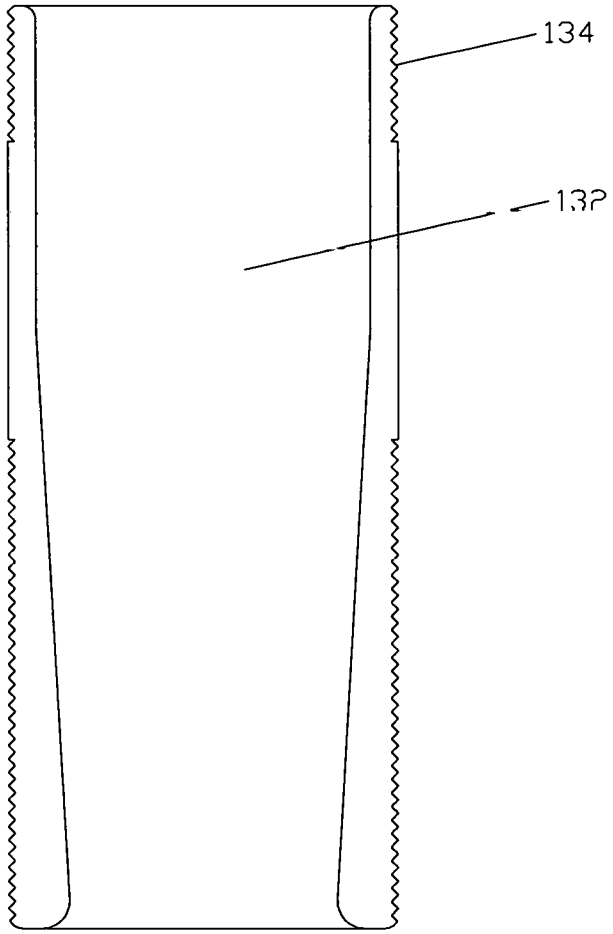
FIG. 6 is a cross-sectional view of a lower mass, streamlined gas cooling nozzle, as shown in FIG. 1.

The design of nozzles 132 represents another unique feature of the present invention. These nozzles have a smaller outer radius (thinner wall) to reduce the mass of the nozzle as compared to the nozzles described and shown in U.S. Pat. Nos. 9,187,799 and 7,514,035. The present lower mass nozzle design results in improved energy efficiency and is an important improvement of the present invention. Nozzles 132, as shown in FIG. 1 and with more detail in FIG. 6, are preferably made from low thermal conducting refractory material, desirably and more specifically graphite. Nozzle 132 has a threaded end 134 that is screwed into hot zone support ring 122. The nozzle is tightened into place by retaining nuts 136. One nut 136 is screwed in at the inner wall formed by insulation boards 130, and a second nut 136 is screwed in against the outside of support ring 122, which is adjacent to insulation boards 130, such that the second retaining nut is in the plenum 123 side of the furnace. Retaining nuts 136 are placed on each side of a board 130 to ensure that nozzles 132 stay in place. Nuts 136 are typically manufactured from graphite, but they can be made from molybdenum (or its alloys) or from ceramic material. The key feature of the nozzle 132 design resides in its lower overall mass.

Figure 2:
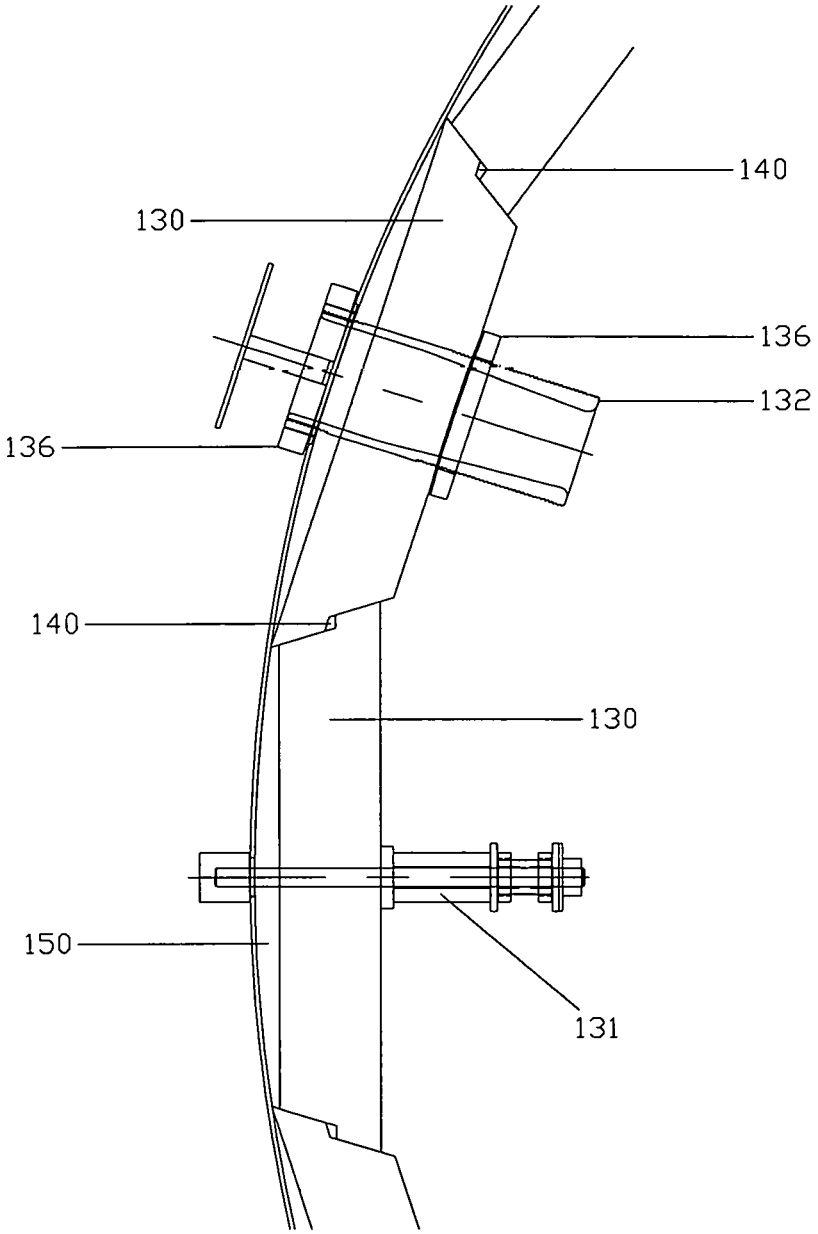
FIG. 2 is a cross-sectional view of the HEFVAC insulation boards as shown in FIG. 1, particularly illustrating the unique Z-shaped profile locking configuration between adjacent boards; and also showing the gas cooling nozzles and their means of retention to the insulation boards and the outer support ring, and the retainer pins and their means of retention to the insulation boards and the outer support ring.

Insulation boards 130, shown in greater detail in FIG. 2, are made of highly efficient, high strength, high density, low conductivity, and low moisture-sensitive graphite (HEFVAC), manufactured according to a proprietary process. Boards 130 are manufactured to tightly set specifications in order to fit the cylindrical hot zone 121 diameter. Each insulation board 130 segment is connected at one of the longitudinal edges thereof to one of the longitudinal edges of an adjacent board 130 segment by means of a unique Z-shaped edge design 140 on each longitudinal edge of every board. Each board is placed in an inverted position against an adjacent board such that the boards fit together in a complementary engagement manner with each other, and Z-joints 140 overlap and engage each other to form a cohesive ring around and the inner wall of hot zone chamber 121. This arrangement of board 130 segments joined together at Z-joints 140 is clearly shown in FIG. 2. The Z-joints do not require any manual cutting to properly fit the furnace hot zone 121 during construction of furnace 100. The Z-joints are designed to self-adjust during the heating cycle to provide a tight fit without leaving major gaps at the board junctions 140. Standard right-angled rigid graphite boards, currently used in prior art felt board construction, are not capable of overlapping at the joint between two boards to form a cohesive insulation ring like the present Z-shaped boards described and shown in FIG. 2. This causes large openings at the junctures of these right-angled rigid boards, which results in radiation losses from the hot zone during the heating cycle. The dimensions of each insulation board 130 according to the present design is determined by the overall diameter of hot zone 121, such that a polygon layout is formed within the hot zone. This layout results in the flat board 130 segments making limited contact with hot zone support ring 122. The reduction of direct contact points between insulation board 130 segments and support ring 122 reduces conductive heat loss that is typical with prior art designs, another factor resulting in an increase in energy efficiency. A void 150 between the flat side of board 130 segments and hot zone support ring 122 is under vacuum during the heat treating cycle, providing insulation between boards 130 and support ring 122, thus further decreasing thermal conductive losses from the hot zone during the heat treating cycle.

While the present preferred embodiment utilizes flat insulation board 130 segments, it should be understood by those skilled in the high temperature vacuum furnace art that curved (or other-shaped) insulation boards could be used that would form a continuous curved layout within hot zone 121 when connected together in the unique manner described and illustrated herein, without departing from the scope of the present invention. Such a design would, however, eliminate the additional advantage of the thermal vacuum gap 150 provided by the flat boards 130 and circular support ring 122.

The design of board 130 segments is show in greater detail in FIG. 2. The HEFVAC graphite boards are cut in such a way that each board has a Z-shaped profile at each longitudinal edge. When the boards are placed end-to-end, they form a Z-joint 140, which is designed in such a way that alternating boards are inverted, and each board lies against the adjacent board forming a seal. The design of Z-joints 140 provides a means for self-adjustment as it swells and shrinks slightly during heating and cooling, and also provides a tight fit during the heating cycle. This reduces radiation thermal losses that would occur from a gap between the boards, as in prior art designs.

The Z-joint lying in the longitudinal direction also provides a simple means for replacement of insulation board 130 segments by the furnace owner or operator, as a damaged board 130 segment can be removed and a new replacement board segment can easily be slid into place in a matter of several hours without the need to completely remove the entire hot zone 121. When a prior art graphite felt insulation package is damaged in a vacuum furnace hot zone, the entire hot zone must be removed from the furnace, and the furnace must be completely shut down for a period of several days to weeks for maintenance. The prior art hot zones built with rigid graphite boards require custom fitting to each hot zone. This must be done during the actual hot zone construction in the furnace manufacturing facility and is time consuming with a great deal of wasted product. The present HEFVAC graphite board 130 segments are precut at the board manufacturing facility to tightly set specifications in order to fit the furnace hot zone diameter. The boards are coated with graphite polymer paint in order to seal each board for less moisture absorption (especially on humid days), and then the boards are pre-conditioned by being baked at a temperature of 1800° C. prior to delivery to the furnace manufacturer. This provides for minimal out-gassing and introduction of contaminating gasses during the heating up portion of the cycle in the furnace. It also allows faster and deeper vacuum levels for each given cycle, and reduced cycle times with less energy consumption. The board 130 segments are then positioned end-to-end and inverted with respect to each other, with opposing Z-joints 140 overlapping to complete the hot zone 121 insulation package in a matter of hours rather than days. All necessary apertures for the components of hot zone 121—nozzles 132, insulation retainers 131 and heating element 151—are pre-drilled in board 130 segments to the specifications of each component prior to assembly of the insulation package. Maintaining tight specifications of the apertures virtually eliminates thermal radiation losses from the exposed space between insulation board 130 segments and hot zone support ring 122. Insulation retainer pins 131 are preferably made from graphite, but they can also be made from molybdenum, and are threaded and held in place by a self-adjusting graphite nut 133.

Figure 3:
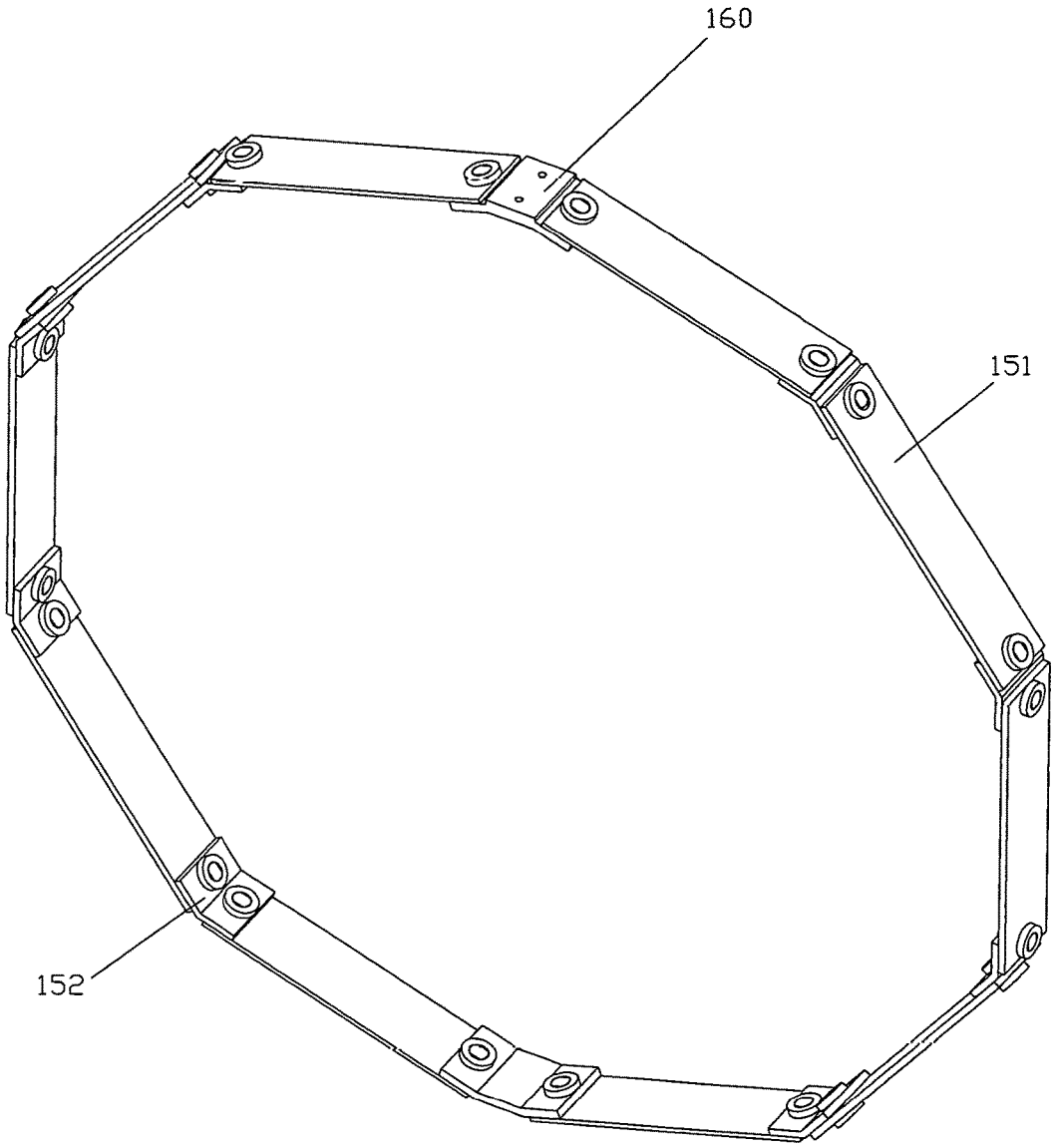
FIG. 3 is a perspective view of a polygonal heating element as shown in FIG. 1, particularly showing the connection means between each heating element segment.
Figure 4:
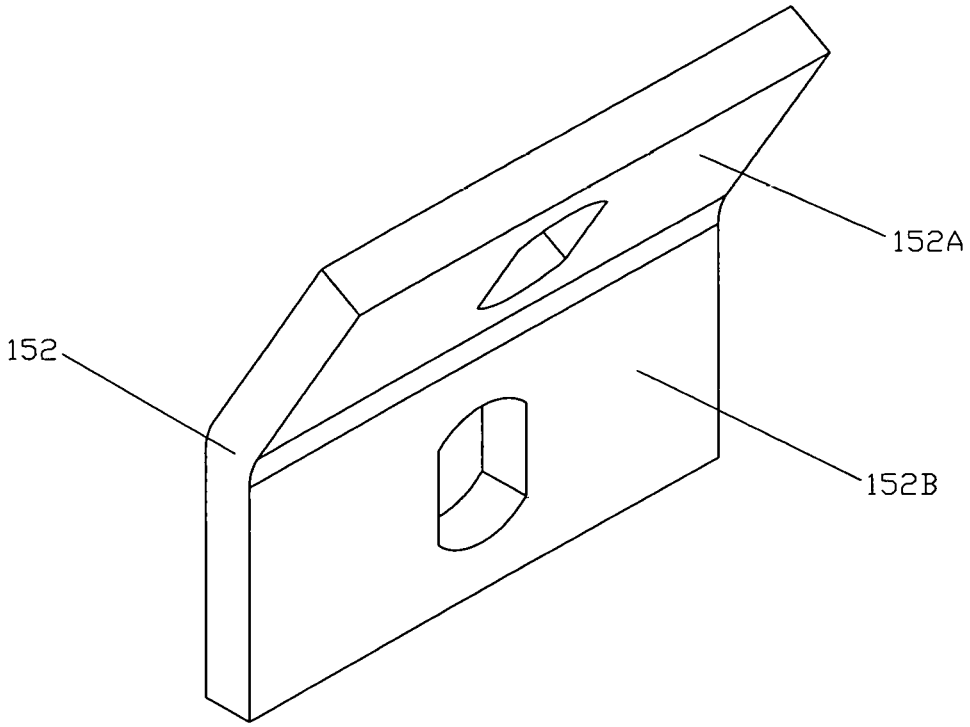
FIG. 4 is a side view of a heating element connector plate for individual heating element segments.

FIGS. 1 and 3 show in detail the new polygon-shaped heating element design. Each heating element 151 is manufactured from a single high purity graphite block and cut into segments having identical dimensions, thereby providing rectangular segments with equal resistance. The ability to manufacture more than one element segment from a single block of graphite significantly reduces the overall cost of the heating element 151 ring compared to the standard curved design, in which each graphite block produces only one graphite heating element. An additional benefit of the present design and method of production is that the process reduces waste of the graphite block material, and therefore is environmentally friendly due to less waste material to dispose of or recycle. This results in a significant cost saving to the furnace manufacturer and to the furnace owners and users.

Figure 5A:
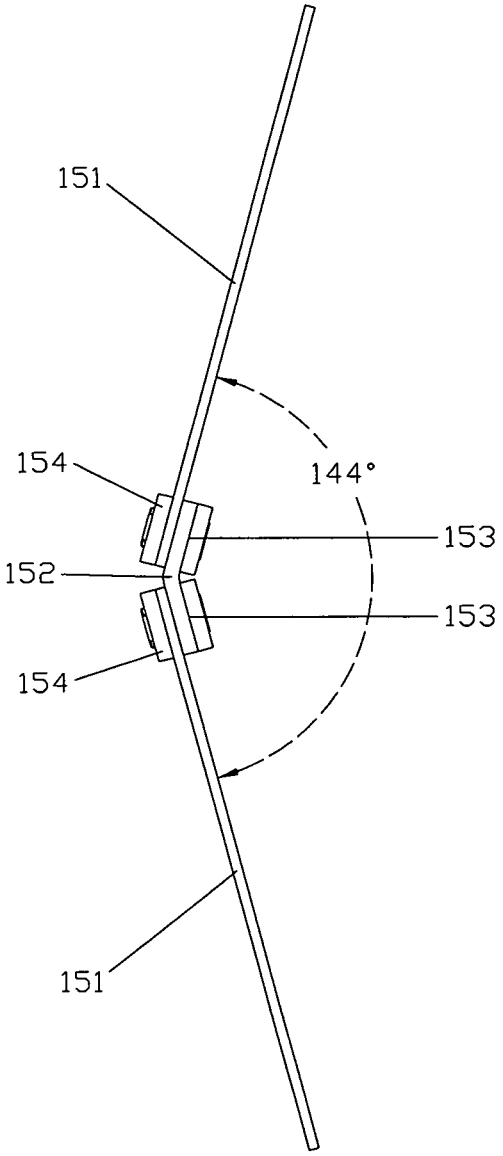
FIG. 5A is a side view showing two individual heating element segments connected by a connector plate, as shown in FIG. 4.
Figure 5B:
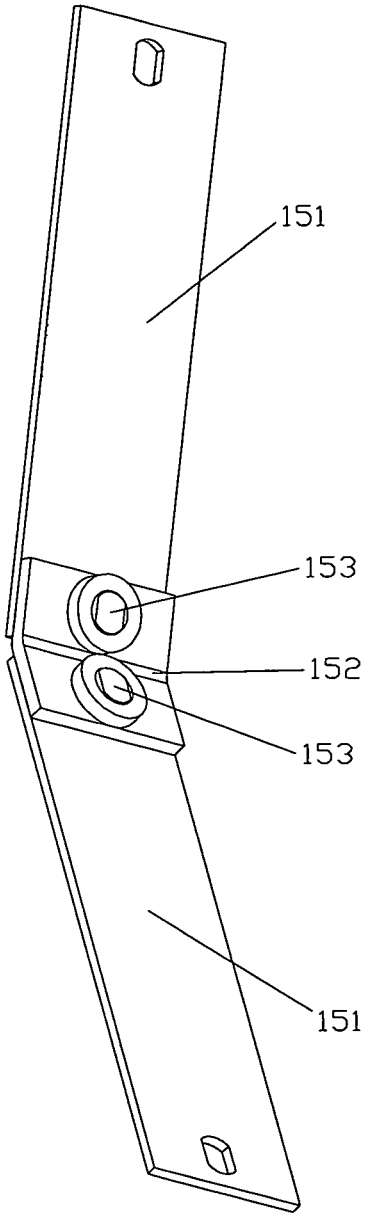
FIG. 5B is a perspective view showing two connected heating element segments, as shown in FIG. 5A.

In prior art designs any hardware used as a connecting means to ensure that the heating elements function in series introduces a means for wear and fracturing of the heating elements during the lifetime of the vacuum furnace, resulting in furnace down time and added maintenance costs. Reduction of the number of connectors not only reduces the risk of fracture, but also reduces the overall mass of the graphite element system, thus saving on the energy needed to heat the elements to the desired furnace temperature. As shown in FIGS. 3, 5A and 5B, each heating element is connected in series by an angled graphite connection member 152 which is secured to adjacent heating element 151 segments by a bolt 153 and a nut 154. Connection member 152 is manufactured preferably from graphite to an internal angle of between 90° to 180°, and preferably between 100° to 165° depending on the diameter of hot zone 121. For example, a hot zone 121 with a 57 inch diameter would require connection members with the angle between sections 152A and 152B of 144°, as shown in FIG. 5A. Heating element 151 segment dimensions depend on the diameter of the hot zone. The width, length and thickness of segments 151 are adjusted to provide maximum coverage and ensure that each segment has a substantially similar, or preferably, exact resistance to prevent electrical arcing.

Power terminal 138, which supplies electrical power to heating elements 151, is connected at one end thereof to water-cooled furnace outer wall 120 through an aperture in an insulation board 130 segment, and at the other end thereof to a connector plates 160 securing the two heating element 151 segments adjacent power terminal 138 together. The heating element 151 ring is connected in part to support ring 122 through apertures in insulation board 130 segments that do not otherwise have any other connection means therebetween by a plurality of element stand-offs 139, which are connected at one end thereof to one of the heating element 151 segments, and at the other end thereof to support ring 122.

Following are examples of energy efficiency comparisons between the vacuum furnace design according to the present invention and various prior art furnace designs. Numerous tests were conducted in a laboratory sized vacuum furnace to compare the overall temperature of the hot zone support ring 122 for various standard insulation packages versus the HEFVAC insulation board 130. Additional testing was conducted for those instances where cooling nozzles were added to the insulation board 130 segments, and the geometry of the hot zone included void 150, which was achieved by attaching a curved plate to the flat insulation board material, thus introducing a void similar to void 150 in FIG. 1. The data for each test is listed in Tables 1 and 2 below:

TABLE 1

| INSULATION TYPE | HOLD 1750° F. | HOLD 2000° F. | HOLD 2250° F. |
|---|---|---|---|
| a. All-Metal (3 Molybdenum, 2 Stainless) | 551° F. | 650° F. | 733° F. |
| b. Foil/Kaowool | 452° F. | 548° F. | 640° F. |
| c. Foil/Rayon Graphite Felt 2" | 456° F. | 544° F. | 616° F. |
| d. Foil/Pan Graphite Felt 2" | 490° F. | 574° F. | 659° F. |
| e. Std. 2" Felt + CFC Graphite Board (Average) | 517° F. | 572° F. | 622° F. |
| f. HEFVAC 2" Board w/Foil Face & Flat Stainless Steel Plate | 334° F. | 367° F. | 405° F. |
| g. HEFVAC 2" Board w/Foil Face & Curved Stainless Steel Plate | 309° F. | 332° F. | 365° F. |

TABLE 2

| THERMAL IMPROVEMENT HEFVAC BOARD | HOLD 1750° F. | HOLD 2000° F. | HOLD 2250° F. |
|---|---|---|---|
| a. Direct Temperature - HEFVAC Flat Plate vs. Std. Felt/Board | 31.79% | 48.22% | 52.09% |
| b. Direct Radiation Loss Improvement Percentage - HEFVAC Board vs. Current Std. Package | 48.46% | 61.16% | 63.97% |

The lower temperatures shown of support ring 122 achieved in tests f. and g. in Table 1 for the two configurations of HEFVAC 2" Board, as compared with the various prior art insulation packages shown in tests a. through e. in Table 1, is evidence of the conclusion that there was less radiative and conductive heat loss from hot zone 121, and therefore increased thermal efficiency with the unique HEFVAC insulation board configuration.

While there have been described what is believed to be a preferred embodiment of the invention, those skilled in the art will recognize that other and further modifications, may be made thereto without departing from the spirit and scope of the invention. It is therefore intended to claim all such embodiments that fall within the scope of the invention.

What is claimed is:

1. A high temperature vacuum furnace including a hot zone being formed to accept and heat treat a stationary workload, said hot zone comprising an inner wall and an outer support means, said inner wall comprising a plurality of high density, high strength, low conductivity, and low moisture-sensitive flat graphite insulation board members, each insulation board member being connected at one longitudinal edge thereof to an adjacent board member to form a continuous ring around said hot zone, and each one of said insulation board members overlapping and engaging the adjacent insulation board member to provide a tight fit with virtually no gap therebetween, each longitudinal edge thereof formed in a z-shaped profile including a first substantially vertical angled surface extending from a first substantially horizontal surface of said board member and a second substantially vertical angled surface extending from a second substantially horizontal surface of said board member, said first and second substantially vertical angled surfaces being connected therebetween by a third substantially horizontal surface, and each board member being placed against an inverted one of said adjacent board members such that the z-shaped edge profile of each board member fits in a complementary engagement position with said adjacent board member and forms a tight fit with virtually no thermal or radiation gap therebetween, whereby thermal radiation losses from said hot zone are virtually eliminated, said hot zone further including a plurality of electrical resistance heating element means arranged in a continuous ring within said hot zone adjacent to said insulation board member ring, each one of said heating element means being operatively connected to an adjacent one of said heating element means at each of their respective longitudinal edges by a first connection means, said heating element means ring being operatively connected to said insulation board member ring by a plurality of heating element standoff means.

2. The high temperature vacuum furnace hot zone in accordance with claim 1 wherein one end of said heating element standoff means is operatively connected through a first aperture in a first one of said insulation board members to said hot zone outer support means and the other end of said standoff means is operatively connected to a first one of said heating element means.

3. The high temperature vacuum furnace hot zone in accordance with claim 1 wherein said hot zone further comprises gas cooling nozzle means and wherein one end of said gas cooling nozzle means is operatively connected through a second aperture in a second one of said insulation board members to said hot zone outer support means and another end of said gas cooling nozzle means is operatively connected to a second one of said insulation board members.

4. The high temperature vacuum furnace hot zone in accordance with claim 3 wherein the ones of said insulation board members that are not otherwise secured to said hot zone outer support means by said heating element standoff means and said gas cooling nozzle means are secured to said hot zone outer support means by retainer pin means, one end thereof being operatively secured to said outer support means and the other end thereof being operatively secured to said insulation board members.

5. The high temperature vacuum furnace hot zone in accordance with claim 3 wherein said gas cooling nozzle means has a reduced mass for providing greater thermal energy efficiency and reduced conductive heat loss from said hot zone.

6. The high temperature vacuum furnace hot zone in accordance with claim 1 wherein said hot zone further comprises power terminal means for supplying electrical power to said heating element means, said power terminal means being operatively connected at one end thereof to an outer wall of the furnace and being operatively connected at another end thereof through said hot zone outer support means and through a third aperture in a third one of said insulation board members to said heating element means.

7. The high temperature vacuum furnace hot zone in accordance with claim 1 wherein said heating element first connection means is in the form of a connector plate means having more than one aperture therein formed to accept fastening means for securing said connector plate means to two adjacent heating element means.

8. The high temperature vacuum furnace hot zone in accordance with claim 7 wherein said connector means is formed with an angle of between approximately 90° to 180° between the ends thereof.

9. The high temperature vacuum furnace hot zone in accordance with claim 7 wherein said connector means is formed with an angle of between approximately 100° to 165° between the ends thereof.

10. The high temperature vacuum furnace hot zone in accordance with claim 7 wherein said connector means is formed with an angle of approximately 144° between the ends thereof.

11. The high temperature vacuum furnace hot zone in accordance with claim 1 wherein a void is formed between said insulation board members and said hot zone outer support means to provide an additional vacuum barrier resulting in improved thermal insulation and reduced conductive heat loss from said hot zone.

12. The high temperature vacuum furnace hot zone in accordance with claim 1 wherein the furnace includes a water-cooled outer wall and a void between said furnace outer wall and said hot zone outer wall forming a plenum for the transmission of high velocity cooling gas to flow through said gas cooling nozzle means to the workpiece in said hot zone.

13. The high temperature vacuum furnace hot zone in accordance with claim 1 wherein said insulation board members are in the shape of a polygon.

14. The high temperature vacuum furnace hot zone in accordance with claim 1 wherein said insulation board members are in a continuous curved shape.

15. The high temperature vacuum furnace hot zone in accordance with claim 1 wherein said heating element means is in the shape of a polygon.

16. The high temperature vacuum furnace hot zone in accordance with claim 1 wherein said hot zone outer support means is in the shape of a continuous ring.

17. The high temperature vacuum furnace hot zone in accordance with claim 16 wherein said hot zone outer support ring is made of stainless steel.

18. The high temperature vacuum furnace hot zone in accordance with claim 1 wherein said insulation board members are coated with a polymeric graphite coating means for providing faster pump down rates, deeper vacuum levels, and reduced cycle times with less energy consumption during a heat treating cycle.

* * * * *